US005281347A

United States Patent [19]

Igarashi et al.

[11] Patent Number: 5,281,347

[45] Date of Patent: Jan. 25, 1994

[54] LUBRICATING COMPOSITION FOR INTERNAL COMBUSTION ENGINE

[75] Inventors: Jinichi Igarashi; Masakuni Hirata, both of Tokyo, Japan

[73] Assignee: Nippon Oil Co., Ltd., Japan

[21] Appl. No.: 937,435

[22] Filed: Aug. 27, 1992

Related U.S. Application Data

[63] Continuation of Ser. No. 584,532, Sep. 18, 1990, abandoned.

[30] Foreign Application Priority Data

Sep. 20, 1989 [JP] Japan ..... 1-243923

[51] Int. Cl.[5] ..... C10M 135/18

[52] U.S. Cl. ..... 252/42.7; 252/46.4; 252/47.5

[58] Field of Search ..... 252/42.7, 46.4, 475

[56] References Cited

U.S. PATENT DOCUMENTS 2,265,851 5/1940 Matheson ..... 252/46.4
3,419,589 12/1968 Larson ..... 252/46.4
4,178,258 12/1974 Papay ..... 252/32.7 E
4,529,526 7/1985 Inoue ..... 252/32.7 E
4,846,983 7/1989 Ward, Jr. ..... 252/46.4
4,952,303 8/1990 Bortz ..... 208/18

*Primary Examiner*—Ellen M. McAvoy
*Attorney, Agent, or Firm*—Ostrolenk, Faber, Gerb & Soffen

[57] ABSTRACT

The present invention provides a lubricating composition for internal combustion engines comprising (A) a lubricating base oil in an amount of about 100 parts by weight, and (B) a molybdenum dithiocarbamate in a amount within the range of from about 0.1 to about 3.0 parts by weight, said lubricating base oil consisting substantially of a hydro-cracked lubricating base oil in an amount of more than 70% by weight (on the basis of the amount of the lubricating base oil) wherein the hydro-cracked lubricating base oil is manufactured by hydro-cracking petroleum fraction and has a kinematic viscosity in the range of from about 2 to about 10 cSt at 100° C., said hydro-cracked lubricating base oil containing aromatic hydrocarbons in an amount within the range of from about 3 to about 15% by weight, sulfur in an amount of less than 50 ppm by weight, and nitrogen in an amount of less than 5 ppm by weight on the basis of the amount of the hydro-cracked lubricating base oil.

6 Claims, No Drawings

LUBRICATING COMPOSITION FOR INTERNAL COMBUSTION ENGINE

This is a continuation of application Ser. No. 07/584,532 filed on Sep. 18, 1990, now abandoned.

BACKGROUND OF THE INVENTION (1) Field of the Invention

This invention relates generally to a lubricating composition for internal combustion engines. More specifically, it relates to a fuel-saving internal combustion engine lubricating composition comprising a lubricating base oil and a molybdenum dithiocarbamate wherein said lubricating base oil contains a hydro-cracked lubricating base oil (2) Description of the Prior Art Because of increased concern about the energy-saving measures to counter oil shocks, the search for a fuel-saving internal combustion engine lubricating oil has intensified recently. As for the fuel-saving measures by lubricating oil to meet the situation, the following measures are now under review among business circles:

(a) Lowering viscosity of lubricating oil with the intention of reducing engine friction loss under hydrodynamic lubricating conditions, and (b) Addition of friction reducing agents with the intention of reducing engine friction loss under mixed and boundary lubrication.

Addition of friction reducing agents to lubricating oil is indispensable in particular in a latest fuel-saving lubricating oil, and many compounds have heretofore been found to be useful. Among them, organic molybdenum compounds are most effective and widely used. Applicants have been investigating the effect of the addition of a variety of such compounds to fuel-saving lubricating composition for internal combustion engines for many years. As a result, applicants have confirmed that the addition of the organic molybdenum compounds is effective in most cases to strengthen the fuel-saving properties of the internal combustion engine lubricating oil. However, it has been observed that even though the most compounds possess a highly fuel-saving effect on the fresh lubricating oil, they gradually lose said effect in the aged lubricating oil by degradation during engine operation. Applicants have also found that molybdenum dithiocarbamates are, among the other organic molybdenum compounds, is hard to degraded and resistant to lowering of the fuel-saving effect. However, applicants' experience has not shown that molybdenum dithiocarbamate can maintain persistently the fuel-saving effect throughout the engine operation.

Strictly speaking, "low fuel consumption" referred to in the present invention means that any lubricating oil can maintain its fuel-saving properties similar to that of a freshly prepared lubricating oil over a long period of time under severe engine operating conditions.

On the basis of the results obtained in extensive testing molybdenum dithiocarbamate for use as a fuel-saving lubricating additive, we have found that the problem above described can be solved by using a lubricating composition of the present invention comprising (A) a lubricating base oil consisting substantially of a hydro-cracked lubricating base oil which contains a small amount of aromatic hydrocarbons, and (B) a molybdenum dithiocarbamate.

OBJECT OF THE INVENTION

It is an object of the subject invention to provide a fuel-saving internal combustion engine lubricating composition comprising a lubricating base oil and a molybdenum dithiocarbamate as an essential component wherein the lubricating base oil consists substantially of a hydro-cracked lubricating base oil which contains a small amount of aromatic hydrocarbons.

SUMMARY OF THE INVENTION

The present invention provides a lubricating composition for internal combustion engines comprising (A) a lubricating base oil in an amount of about 100 parts by weight, and (B) a molybdenum dithiocarbamate in an amount within the range of from about 0.1 to about 3.0 parts by weight, said lubricating base oil consisting substantially of a hydro-cracked lubricating base oil in an amount of more than 70% by weight (on the basis of the amount of the lubricating base oil) wherein the hydro-cracked lubricating base oil is manufactured by hydro-cracking petroleum fraction and has a kinematic viscosity in the range of from about 2 to about 10 cSt at 100° C., said hydro-cracked lubricating base oil containing aromatic hydrocarbons in an amount within the range of from about 3 to about 15% by weight, sulfur in an amount of less than 50 ppm by weight, and nitrogen in an amount of less than 5 ppm by weight on the basis of the amount of the hydro-cracked lubricating base oil.

DETAILED DESCRIPTION OF THE INVENTION

Any known hydro-cracking process for manufacturing the hydro-cracked lubricating base oil in the present invention is acceptable. As an example, such hydro-cracking processes include a process for hydro-cracking a petroleum fraction prepared from paraffinic crude oil by vacuum distillation followed by optional deasphalting. The hydro-cracking conditions are usually as follows:

Temperature 350°–500° C., Pressure 60–200 $Kg/cm^2$, LHSV 0.1–2.0 $h^{-1}$.

The catalyst for hydro-cracking is selected from the group consisting of molybdenum, chromium, tungsten, vanadium, platinum, nickel, copper, iron, cobalt, salts thereof, oxides and/or sulfides thereof, as well as mixtures thereof. The catalyst may be used with a suitable carrier such as silica-alumina, active alumina, zeolite, and the like.

The hydro-cracked lubricating base oil manufactured by hydro-cracking may be further treated, if necessary, by solvent extraction, solvent dewaxing, catalytic dewaxing, hydro-refining, and the like.

It is necessary that the hydro-cracked lubricating base oil produced by above processes has a kinematic viscosity in the range of from about 2 to about 10 cSt at 100° C., preferably from about 3 to about 7 cSt at 100° C., and contains aromatic hydrocarbons in an amount within the range of from about 3 to about 15% by weight, preferably from about 3 to 8% by weight, sulfur in an amount of less than 50 ppm by weight, preferably less than 20 ppm by weight, and nitrogen in an amount of less than 5 ppm by weight, preferably less than 2 ppm by weight.

A kinematic viscosity of the hydro-cracked lubricating base oil of less than about 2 cSt at 100° C. is not preferable, because of the poor ability of the composition of the present invention to form an oil film between metal-metal contact area and of an increase of evaporation loss. A kinematic viscosity of the hydro-cracked lubricating base oil of more than about 10 cSt at 100° C. is not also preferable because of an increase of frictional loss under a condition of hydrodynamic lubrication and of the insufficient display of the fuel-saving effect of molybdenum dithiocarbamate (B). While aromatic hydrocarbon contents of less than about 3% by weight are not preferable because of the insufficient solubility of molybdenum dithiocarbamate (B), aromatic hydrocarbon contents of over about 15% by weight are not also preferable because of the insufficient oxidation stability of the composition of the present invention. The aromatic hydrocarbon contents was measured by the procedures as provided by ASTM D2549.

Furthermore, sulfur contents in an amount of over about 50 ppm by weight or nitrogen contents in an amount of more than about 5 ppm by weight are not also preferable because of the insufficient oxidation stability of the composition of the present invention. A viscosity-index number of more than about 120 of the hydro-cracked lubricating base oil is preferable in the present invention.

The lubricating base oil (A) of the present invention contains a hydro-cracked lubricating base oil mentioned above in an amount of more than about 70% by weight, preferably more than about 80 weight % by weight, wherein the balance may be any lubricating base oil such as mineral base oil or synthetic base oil such as polybutene, polyisobutylene, α-olefin oligomer, alkylbenzene, an alkylnaphthalene, diester, polyol ester, polyglycol, polyphenyl ether, silicon oil, and each of the like.

The content of the hydro-cracked lubricating base oil in an amount of less than about 70% by weight is not preferable because of the insufficient oxidation stability of the composition of the present invention.

The molybdenum dithiocarbamate (B) employed in this invention are compounds having the structure

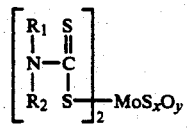

wherein $R_1$ or $R_2$ is the same or different, and is alkyl group of 1 to 18 carbons, cycloalkyl group, aryl group, alkylaryl group, or arylalkyl group, and x or y is a integer from 0 to 4 which satisfies $x+y=4$.

A mixture of any molybdenum compounds selected from the group consisting of molybdenum compounds having different chemical structures may be employed. Japanese Patent Application Publication No. 80825/S-51, No. 19629/S-52 and No. 106824/S-52 describes the compounds of molybdenum dithiocarbamate (B), and the disclosures of which are incorporated by reference.

The use of molybdenum dithiocarbamate (B) in an amount within the range of from about 0.1 to about 3.0 parts by weight is preferable, and from about 0.2 to about 2.0 parts by weight on the basis of 100 parts by weight of lubricating base oil (A) is more preferable. (B) in an amount of less than about 0.1 parts by weight is not preferable because such an amount do not provide an adequate fuel-saving effect, and (B) in an amount of over about 3.0 parts by weight is also not preferable because such an amount provides no appreciable and additional benefits.

Several known lubricant additives may be added optionally to the lubricating composition of the present invention. Such additives include zinc dithiophosphates, alkaline-earth metal sulfonates, alkaline-earth metal pheneates, alkaline-earth metal salicylates, alkaline-earth metal phosphonates; and ashless dispersants such as succinimides, succinic esters, benzylamines; viscosity-index improvers and pour point depressants such as polymethyl methacrylate, polyisobutylene, ethylene-propylene copolymer; antioxidants such as phenol type, amine type, copper type; metal deactivators such as benzotriazole; as well as rust preventives; defoaming agents; oiliness agents/friction modifiers and the like.

Any single or combination of the lubricant additives mentioned above may be employed although the kind and the amount of such lubricant additives may be selected suitably on the basis of the grades described in "the API service classification for engine oil". The total amount of the additives employed is usually less than 35 parts by weight, preferably less than 25 parts by weight on the basis of 100 parts by weight of the lubricating base oil (A). The composition for internal combustion engines of the present invention is suitable for use, for example, as four-cycle gasoline engine oil, diesel engine oil for land use, marine diesel engine oil, two-cycle diesel engine oil, and the like.

In order to further illustrate the composition of the present invention, the following specific examples are provided. It will be understood that the examples as hereinafter set forth are provided for illustrative purposes and are not intended to be limiting of the invention as herein disclosed and as set forth in the subjoined claim.

EXAMPLE 1-2, COMPARATIVE EXAMPLE 1-2

The lubricating compositions employed in Examples and comparative Examples are shown in Table 1.

The test methods for evaluating properties of lubricating oil are as follows:

(Falex Test)

Falex tests were carried out both new and oxidation degraded sample oils under the following conditions:

1500r.p.m.×30lb,80° C.

The oxidation degraded sample oils were prepared by oxidizing new sample oils under the following conditions on the basis of "the method for testing oxidation stability of lubricating oil" as provided by JIS K 25143.1:

Test temperature: 150° C.

Test duration: 144 hrs.

(Engine Test)

After a sample oil was degraded by Firing test under a high speed engine operating condition in an urban area for 50 hours, a change in engine friction loss torque was measured under the following motoring conditions.

Engine speed: 1500 r.p.m.

Temperature of oil: 80° C.

Table 1 shows the test results.

TABLE 1

| | Example 1 | Example 2 | Com. Exp. 1 | Com. Exp. 2 |
|---|---|---|---|---|
| Composition | | | | |

TABLE 1-continued

| | Example 1 | Example 2 | Com. Exp. 1 | Com. Exp. 2 |
|---|---|---|---|---|
| (Parts by weight) | | | | |
| Hydro-cracked Oil 100° C., Viscosity 3.9 cST, Aromatics 7.9% by Wt. Sulfur 2 ppm, Nitrogen <1 ppm | 100 | 100 | — | — |
| Solvent Refined Oil 100° C., Viscosity 3.9 cST, Aromatics 26.0% by Wt. Sulfur 0.17 ppm, nitrogen 18 ppm | — | — | 100 | 100 |
| Di(2-ethylhexyl) molybdenum dithiocarbamate* | 0.41 | 0.41 | 0.41 | — |
| Di(2-ethylhexyl) molybdenum (dithiophosphate*) | — | — | — | 0.41 |
| SG grade package additive (commercially available) | 13.3 | 13.3 | 13.3 | 13.3 |
| Copper type antioxidant | — | 0.12 | — | — |
| Polymethacrylate | 7.5 | 7.5 | 7.5 | 7.5 |
| Physical Properties | | | | |
| Viscosity 40° C. cST | 37.77 | 37.77 | 42.39 | 42.43 |
| 100° C. cST | 9.49 | 9.49 | 9.42 | 9.45 |
| Viscosity Index | 249 | 249 | 215 | 215 |
| Properties of lubricating oil | | | | |
| A change in Falex friction coefficient after ISO test (150° C., 144 hrs) | | | | |
| before test | 0.040 | 0.040 | 0.040 | 0.045 |
| after test | 0.070 | 0.060 | 0.090 | 0.110 |
| A change in engine friction loss torque (Kg f · m) | | | | |
| before test | 1.97 | 1.97 | 1.97 | 1.98 |
| after test | 2.02 | 2.00 | 2.07 | 2.10 |

*Assumed amount of molybdenum in oil is 0.07 wt. %

What is claimed is:

1. A lubricating composition for internal combustion engines comprising (A) a lubricating base oil in an amount of about 100 parts by weight, and (B) a molybdenum dithiocarbamate in an amount within the range of from about 0.1 to about 3.0 parts by weight, said lubricating base oil consisting essentially of a hydro-cracked lubricating base oil in an amount of more than 70% by weight (on the basis of the amount of the lubricating base oil) wherein the hydro-cracked lubricating base oil is manufactured by hydro-cracking petroleum fraction and has a kinematic viscosity in the range of from about 2 to about 10 cSt at 100° C., said hydro-cracked lubricating base oil containing aromatic hydrocarbons in an amount within the range of from about 3 to about 15% by weight, sulfur in an amount of less than 50 ppm by weight, and nitrogen in an amount of less than 5 ppm by weight on the basis of the amount of the hydro-cracked lubricating base oil.

2. A lubricating oil composition for internal combustion engines according to claim 1 in which said lubricating base oil has a kinematic viscosity in the range from about 3 to about 7 cSt at 100° C., contains aromatic hydrocarbons within the range of about 3 to about 8% by weight, sulphur in an amount of less than 20 ppm by weight and nitrogen in an amount of less than 2 ppm by weight.

3. A lubricating oil composition for internal combustion engines according to claim 2 in which said hydro-cracked lubricating base oil is present in an amount of more than about 80% by weight.

4. A lubricating oil composition for internal combustion engines according to claim 3 in which the amount of molybdenum dithiocarbamate is within the range from about 0.2 to about 2 parts by weight.

5. A lubricating oil composition for internal combustion engines according to claim 1 in which the amount of molybdenum dithiocarbamate is within the range from about 0.2 to about 2 parts by weight.

6. A lubricating oil composition for internal combustion engines according to claim 1 in which said hydro-cracked lubricating base oil is present in an amount of more than about 80% by weight.

* * * * *